US008561305B2

(12) United States Patent
Davis et al.

(10) Patent No.: US 8,561,305 B2
(45) Date of Patent: Oct. 22, 2013

(54) ADJUSTABLE UTILITY KNIFE

(75) Inventors: Raymond E. Davis, Heath, TX (US); Clifton Glenn Hampton, Burleson, TX (US)

(73) Assignee: ADCO Industries—Technologies, L.P., Dallas, TX (US)

( * ) Notice: Subject to any disclaimer, the term of this patent is extended or adjusted under 35 U.S.C. 154(b) by 0 days.

(21) Appl. No.: 13/595,406

(22) Filed: Aug. 27, 2012

(65) Prior Publication Data

US 2013/0014391 A1 Jan. 17, 2013

Related U.S. Application Data

(63) Continuation of application No. 12/104,338, filed on Apr. 6, 2008, now Pat. No. 8,250,764.

(60) Provisional application No. 60/911,982, filed on Apr. 16, 2007.

(51) Int. Cl.
*B26B 1/08* (2006.01)

(52) U.S. Cl.
USPC ..... 30/162; 30/335

(58) Field of Classification Search
USPC ..... 30/2, 162, 335
See application file for complete search history.

(56) References Cited

U.S. PATENT DOCUMENTS

| | | | |
|---|---|---|---|
| 1,250,538 | A | 12/1917 | Williams |
| 2,018,149 | A | 10/1935 | Randle et al. |
| 2,616,172 | A | 11/1952 | Parker |
| 3,439,419 | A | 4/1969 | Fleming |
| 3,613,241 | A | 10/1971 | Allen |
| 3,824,688 | A | 7/1974 | Goffe |
| 3,991,467 | A | 11/1976 | Yokoyama |
| 4,048,719 | A | 9/1977 | Thompson |
| 4,134,206 | A | 1/1979 | Beermann |
| 4,139,939 | A | 2/1979 | Crooks |

(Continued)

FOREIGN PATENT DOCUMENTS

| | | | |
|---|---|---|---|
| DE | 198704973 | U1 | 8/1987 |
| DE | 4315495 | A1 | 11/1994 |

(Continued)

OTHER PUBLICATIONS

Office Action mailed Feb. 7, 2011, in U.S. Appl. No. 11/735,997 (10 pages).

(Continued)

*Primary Examiner* — Hwei C Payer
(74) *Attorney, Agent, or Firm* — Fish & Richardson P.C.

(57) ABSTRACT

A knife includes a handle enclosing one or more of a blade, a blade shuttle, a transmission, and a trigger, where the handle includes a blade aperture. The blade shuttle is longitudinally moveable relative to the handle from a rest position to a first extended position and the blade shuttle is moveable longitudinally from the first extended position to a cutting position when the blade is engaged in a workpiece. The blade shuttle is automatically retracted from the cutting position to the rest position when the blade is disengaged from the workpiece. The blade is detachably secured within the blade shuttle and protrudes a first distance through the blade aperture at the first extended position. The blade is extended from the first distance a substantially fixed length when engaged in the workpiece. The blade is adapted to automatically retract within the handle when disengaged from the workpiece.

20 Claims, 10 Drawing Sheets

(56) References Cited

U.S. PATENT DOCUMENTS

| | | | | |
|---|---|---|---|---|
| 4,180,908 | A | 1/1980 | Beermann | |
| 4,320,576 | A | 3/1982 | Beermann | |
| 4,531,286 | A | 7/1985 | Vito et al. | |
| 4,683,656 | A | 8/1987 | Peyrot et al. | |
| 4,713,885 | A | 12/1987 | Keklak et al. | |
| 4,757,612 | A | 7/1988 | Peyrot | |
| 4,769,912 | A | 9/1988 | Davis | |
| 4,805,304 | A | 2/1989 | Knoop | |
| 4,835,865 | A | 6/1989 | Knoop | |
| 4,837,931 | A | 6/1989 | Beermann | |
| 4,868,985 | A | 9/1989 | Rehm | |
| 4,899,443 | A | 2/1990 | Beermann | |
| 4,949,458 | A | 8/1990 | Davis et al. | |
| 5,012,581 | A | 5/1991 | Fletcher et al. | |
| 5,133,132 | A | 7/1992 | Yu | |
| 5,203,085 | A | 4/1993 | Berns | |
| 5,299,355 | A * | 4/1994 | Boda et al. | 30/162 |
| 5,303,474 | A | 4/1994 | Keklak et al. | |
| 5,337,482 | A | 8/1994 | Schmidt | |
| 5,384,963 | A | 1/1995 | Beermann | |
| 5,386,632 | A | 2/1995 | Schmidt | |
| 5,426,855 | A | 6/1995 | Keklak et al. | |
| 5,481,804 | A | 1/1996 | Platts | |
| 5,511,311 | A | 4/1996 | Collins | |
| 5,598,634 | A | 2/1997 | Berns | |
| 5,613,300 | A | 3/1997 | Schmidt | |
| 5,617,635 | A | 4/1997 | Berns | |
| 5,647,132 | A | 7/1997 | Berns | |
| 5,735,051 | A | 4/1998 | Berns | |
| 5,737,842 | A | 4/1998 | Freedman | |
| 5,768,787 | A | 6/1998 | Ireland | |
| D401,832 | S | 12/1998 | Keklak et al. | |
| 5,890,294 | A | 4/1999 | Keklak et al. | |
| 5,924,203 | A | 7/1999 | Huang | |
| 6,000,136 | A | 12/1999 | Owens | |
| 6,000,590 | A | 12/1999 | Allen | |
| 6,070,326 | A | 6/2000 | Berns | |
| 6,105,838 | A | 8/2000 | Hansen | |
| 6,148,520 | A | 11/2000 | Berns | |
| 6,192,589 | B1 | 2/2001 | Martone et al. | |
| 6,195,896 | B1 | 3/2001 | Ireland | |
| 6,205,667 | B1 | 3/2001 | Glesser | |
| 6,233,832 | B1 | 5/2001 | Berns | |
| 6,308,418 | B1 | 10/2001 | Sweet | |
| 6,314,646 | B1 | 11/2001 | Schmidt | |
| 6,364,182 | B1 | 4/2002 | Hansen | |
| 6,382,481 | B1 | 5/2002 | McIlmoil | |
| 6,427,374 | B1 | 8/2002 | Vaiani | |
| 6,453,559 | B1 | 9/2002 | Marshall et al. | |
| 6,532,670 | B1 | 3/2003 | Berns | |
| 6,550,144 | B1 | 4/2003 | Berns | |
| 6,553,673 | B2 | 4/2003 | Peyrot et al. | |
| 6,578,266 | B2 | 6/2003 | Chomiak | |
| 6,591,501 | B1 | 7/2003 | Phillips | |
| 6,637,112 | B2 | 10/2003 | Davis | |
| 6,718,637 | B1 | 4/2004 | Ortner et al. | |
| 6,742,261 | B2 | 6/2004 | Ho | |
| 6,775,911 | B2 | 8/2004 | Tremblay | |
| 6,785,966 | B2 | 9/2004 | Berns | |
| 6,813,833 | B2 | 11/2004 | Saunders et al. | |
| 6,817,499 | B2 | 11/2004 | Martinez | |
| 6,874,237 | B2 | 4/2005 | Robitaille | |
| 6,889,879 | B2 | 5/2005 | Rivera et al. | |
| 6,898,856 | B2 | 5/2005 | Mak et al. | |
| 6,907,668 | B2 | 6/2005 | Polei | |
| 6,938,343 | B2 | 9/2005 | Yamagishi | |
| 7,028,406 | B2 | 4/2006 | Polei | |
| 7,082,688 | B2 | 8/2006 | Votolato | |
| 7,540,092 | B2 | 6/2009 | Polei | |
| 7,596,868 | B2 | 10/2009 | Berns | |
| 7,596,869 | B2 | 10/2009 | Berns | |
| 7,647,702 | B2 | 1/2010 | Polei | |
| 7,870,675 | B1 | 1/2011 | Della | |
| 8,056,241 | B2 | 11/2011 | Davis et al. | |
| 8,220,160 | B2 | 7/2012 | Davis et al. | |
| 8,250,764 | B2 * | 8/2012 | Davis et al. | 30/162 |
| 2002/0029482 | A1 | 3/2002 | Peyrot et al. | |
| 2002/0124412 | A1 | 9/2002 | Votolato | |
| 2002/0124418 | A1 | 9/2002 | Votolato | |
| 2002/0162849 | A1 | 11/2002 | Chen | |
| 2003/0042348 | A1 | 3/2003 | Salentine et al. | |
| 2003/0140746 | A1 | 7/2003 | Yamagishi | |
| 2003/0154606 | A1 | 8/2003 | Saunders et al. | |
| 2003/0213823 | A1 | 11/2003 | Papovitch | |
| 2004/0173650 | A1 | 9/2004 | Berns | |
| 2004/0187314 | A1 | 9/2004 | Johnson | |
| 2004/0237312 | A1 | 12/2004 | Hernandez et al. | |
| 2005/0072819 | A1 | 4/2005 | Maldonado et al. | |
| 2005/0217114 | A1 | 10/2005 | Votolato | |
| 2006/0130338 | A1 | 6/2006 | Dzubak et al. | |
| 2006/0130339 | A1 | 6/2006 | Berns | |
| 2007/0101576 | A1 | 5/2007 | Green | |
| 2007/0130778 | A1 | 6/2007 | Ruggiero | |
| 2007/0186424 | A1 | 8/2007 | Becker et al. | |
| 2007/0209209 | A1 | 9/2007 | Davis et al. | |
| 2007/0240314 | A1 | 10/2007 | Ireland | |
| 2007/0245572 | A1 | 10/2007 | Ireland | |
| 2008/0086894 | A1 | 4/2008 | Sullivan | |
| 2008/0086895 | A1 | 4/2008 | Parks | |
| 2009/0094840 | A1 | 4/2009 | Kanemoto et al. | |
| 2010/0088900 | A1 | 4/2010 | Davis et al. | |
| 2010/0187276 | A1 | 7/2010 | Ohmura et al. | |
| 2010/0319200 | A1 | 12/2010 | Davis et al. | |
| 2013/0067751 | A1 * | 3/2013 | Davis et al. | 30/162 |

FOREIGN PATENT DOCUMENTS

| | | | |
|---|---|---|---|
| DE | 19601015 | A1 | 7/1997 |
| DE | 29709671 | U1 | 5/1998 |
| DE | 20202978 | U1 | 6/2002 |
| DE | 20210670 | U1 | 10/2002 |
| DE | 60101654 | T2 | 11/2004 |
| DE | 102005057213 | B3 | 3/2007 |
| EP | 676993 | A4 | 8/1996 |
| EP | 1273399 | B1 | 1/2005 |
| EP | 1674219 | A1 | 6/2006 |
| EP | 1946897 | A1 | 7/2008 |
| EP | 1982802 | A1 | 10/2008 |
| FR | 2552008 | A1 | 3/1985 |
| FR | 2810574 | B1 | 10/2002 |
| GB | 642219 | A | 8/1950 |
| GB | 649406 | A | 1/1951 |
| GB | 2083775 | A | 3/1982 |
| KR | 879807 | B1 | 7/1987 |
| KR | 199003560 | Y1 | 4/1990 |
| KR | 199206556 | B1 | 8/1992 |

OTHER PUBLICATIONS

Final Office Action mailed Jul. 26, 2011, in U.S. Appl. No. 11/735,997 (10 pages).

Office Action mailed Oct. 13, 2011, in U.S. Appl. No. 11/735,997 (8 pages).

Office Action mailed May 23, 2012, in U.S. Appl. No. 11/735,997 (9 pages).

EPO Notice of Opposition mailed Apr. 4, 2012, for European Patent No. 1982802, issued from corresponding Application No. 08154594.9 (73 pages, including certified translation).

EPO Notice of Opposition mailed Apr. 19, 2012, for European Patent No. 1982802, issued from corresponding Application No. 08154594.9 (29 pages EP version, 30 pages English translation including certificate).

European Search Report from the European Patent Office regarding Applicant No. EP 08154594, dated Jul. 4, 2008 (5 pages).

Office Action mailed Jun. 21, 2013, in U.S. Appl. No. 13/765,371(11 pages).

* cited by examiner

ADJUSTABLE UTILITY KNIFE

CLAIM OF PRIORITY

This application is a continuation of, and claims priority under 35 U.S.C. §120 to, U.S. patent application Ser. No. 12/104,338, entitled "Adjustable Utility Knife," and filed Apr. 16, 2008, now U.S. Pat. No. 8,250,764, which claims priority under 35 U.S.C. §119(e) to U.S. Provisional Patent Application Ser. No. 60/911,982, filed on Apr. 16, 2007, the entire contents of both previous applications are hereby incorporated by reference.

TECHNICAL BACKGROUND

This disclosure relates to cutting rigid and semi-rigid materials, and more particularly, to cutting rigid and semi-rigid materials with a knife including an auto-retracting cutting blade.

BACKGROUND

A variety of different materials are often required to be cut into uniform or non-uniform pieces. For example, consumer and commercial packaging, such as corrugated board, cardboard, or other similar paper products, often requires opening by cutting through the packaging. In some cases, a utility knife including an extendable blade may be used to cut through such packaging or, indeed, any other material, such as plastic, rubber, Styrofoam, or lightweight wood products. As with any sharp object, however, the chance of operator injury may be high when working with a utility knife, which includes an exposed blade. Such injuries can occur during the operation of the utility knife in cutting the aforementioned material, or even during periods of non-operation if the user fails to carefully handle the knife. For example, even if a utility knife includes a blade that may be completely concealed within a protective housing until operation, once the knife is actuated to reveal the blade, the responsibility of ensuring that the blade returns to the protective housing is often the user's. In situations where the user forgets to deactivate the knife, thereby causing the blade to return to its protective housing, the exposed blade may cause injury to the user or others.

The material that may require cutting, furthermore, may be of a non-uniform shape and thickness. For example, corrugated board may be manufactured in single wall, twin wall, or triple wall varieties, with increasing thickness from single to triple wall. Other material, such as rubber or plastic, may also have varying thickness. Because of the variety of materials and thickness of such materials, a utility knife designed to cut through a particular material, for instance single wall corrugated board, may not be able to cut through another material, such as triple wall corrugated board. A user, however, may not desire or be able to carry multiple utility knives specially designed to cut different materials.

Corrugated board, in particular, is often used for product boxes. In order to increase efficiency and decrease packaging costs, such boxes are often tightly packed with the product. Opening the boxes through the use of a utility knife, therefore, may also have the unwanted consequence of damaging the product inside should the knife's blade extend too far through the corrugated board box. Controlling a depth of the cut from the blade, however, may be difficult for the operator while still ensuring a clean, thorough cut. User injury may follow if the user attempts to control the depth of the cut through a particularly thick or tough corrugated board box.

SUMMARY

This disclosure relates to cutting rigid and semi-rigid materials, and more particularly, to cutting rigid and semi-rigid materials with a knife including an auto-retracting cutting blade.

In one implementation, a knife includes a handle enclosing at least a portion of one or more of a blade, a blade shuttle, a transmission, and a trigger, where the handle includes a blade aperture. The blade shuttle is longitudinally moveable relative to the handle from a rest position to a first extended position and from the rest position to a second extended position, where the first extended position is different from the second extended position. The blade shuttle is moveable longitudinally from the first extended position and the second extended position to a cutting position when the blade is engaged in a workpiece. The knife is configured such that the blade shuttle is automatically retracted from the cutting position to the rest position when the blade is disengaged from the workpiece. The blade is secured within the blade shuttle, where a distal end of the blade protrudes a first distance from the blade aperture at the first extended position and a second distance from the blade aperture at the second extended position. The first distance is different from the second distance. The knife is configured such that when the distal end of the blade protrudes the first distance from the blade aperture, the distal end of the blade moves to a distance from the blade aperture greater than the first distance from the blade aperture when the blade is engaged in the workpiece. The knife is also configured such that when the distal end of the blade protrudes the second distance from the blade aperture, the distal end of the blade moves to a distance from the blade aperture greater than the second distance from the blade aperture when the blade is engaged in the workpiece. The knife is configured such that the blade is automatically retracted to a safe position within the handle when the blade is disengaged from the workpiece. The trigger is adapted to drive the blade shuttle from the rest position to the first extended position and from the rest position to the second extended position via the transmission. In some specific aspects, the distance from the distal end of the blade to the blade aperture may be approximately 0.028 inches greater than the first distance from the blade aperture when the blade is engaged in the workpiece. Further, the blade shuttle may be adapted to automatically retract from the cutting position to the rest position when the blade is disengaged from the workpiece with the trigger in the actuated position.

In some aspects, the transmission includes a lever; a first spring; and a second spring. The first spring may be coupled to the trigger and may be adapted to direct the lever to engage the blade shuttle in the first extended position and the second extended position and rotate the lever to disengage the lever and the blade shuttle in the cutting position. The second spring may be coupled to the handle and the blade shuttle and may be adapted to automatically retract the blade shuttle from the cutting position to the rest position. In various aspects, the second spring exerts no force on the blade shuttle in the rest position. Further, in some specific aspects, the knife may further include at least a third spring that may be adapted to act between the handle and the trigger and cooperate with the first and second springs to maintain a substantially constant force magnitude required to actuate the trigger and maintain the trigger in the actuated position. The third spring may be adapted to act between the handle and the trigger and cooperate with the first and second springs to maintain a substantially constant force magnitude required to actuate the trigger and maintain the trigger in the actuated position upon the blade engaging the workpiece. In certain specific aspects, the force magnitude may be between approximately 4 ounces and approximately 10 ounces.

In some aspects, the blade shuttle may be moveable longitudinally from the rest position to a third extended position and may be moveable longitudinally from the third extended position to the cutting position when the blade is engaged in the workpiece.

In particular aspects, the knife may further include a position selector interposed between the handle and the trigger and adapted to limit a trigger stroke relative to the handle so as to drive the blade shuttle to one of the first extended position and the second extended position. The position selector may be further adapted to limit the trigger to a lock position, where the blade shuttle may be maintained at the rest position when the trigger is in the lock position. In certain aspects, the position selector may include a stem; a base; and a dial. The base may include a first seat and a second seat. The dial may be accessible to an exterior of the handle and may be coupled to the stem. The dial may be adapted to rotate the stem to a first position selection and a second position selection, where the stem is adapted to protrude into the first seat at the first position selection upon a first actuation of the trigger and the second seat at the second position selection upon a second actuation of the trigger. The blade may be adapted to protrude the first distance through the blade aperture at the first position selection upon the first actuation of the trigger and the second distance through the blade aperture at the second position selection upon the second actuation of the trigger. In certain aspects, the position selector may further include a selector spring adapted to maintain the dial at a selected position. The selected position may include one of the first position selection; the second position selection; a third position selection; and a lock position.

In certain aspects, the handle may further include a front handle edge at the blade aperture, where a plane tangential to the front handle edge and a plane tangential to the cutting edge of the blade define a first obtuse angle. The handle may include a front contour, where a plane tangential to the front contour and a plane tangential to the blade define a second obtuse angle. The first obtuse angle and the second obtuse angle may define a compound angle of cut. The knife may further include a blade guide coupled to the handle where the blade guide may be adapted to direct a cut of the blade at the second obtuse angle.

In more particular aspects, the handle may include a tapered terminal end at the blade aperture adapted to substantially constrain a movement of the blade transverse to a longitudinal dimension of the blade. Additionally, the handle may be a longitudinally coupled two-piece handle assembly.

In certain aspects, the blade shuttle may include a spare blade receptacle and the knife may further include a cover where at least a portion of the cover may be detachably secured to the handle to provide access to the blade. The knife may further include a blade cover, where at least a portion of the blade cover may be detachably secured to the handle to provide access to the spare blade receptacle. In some aspects, the knife may include a handle clip.

Various implementations of a knife according to the present disclosure may include one or more of the following features. For example, the knife may allow for a safer cutting mechanism by automatically retracting a blade of the knife regardless of whether the knife is actuated. As a further example, the knife may utilize a friction force between a blade of the knife and a rigid or semi-rigid workpiece to allow for automatic retraction of the blade into a safe position in the knife. As another example, the knife may allow for multiple depths of cut by a blade of the knife. As yet another example, the knife may allow for a blade of the knife to be automatically retracted into a safe position within the knife from one or more blade extension positions. As another example, the knife may reduce the energy and labor required to cut a rigid or semi-rigid workpiece. The knife may also allow for reduced friction on a blade of the knife thereby increasing the life of the blade. As another example, the knife may allow for reduced friction on a blade of the knife thereby allowing for a cleaner cut of a rigid or semi-rigid workpiece.

In some implementations of a knife as described in the present disclosure, the knife may include the following features. For instance, the knife may ensure that a mechanical action of the knife experiences minimal malfunctions by reducing contaminants from entering the knife. As another example, the knife may include a two-piece assembly housing that prevents user access to an interior of the assembly housing in order to avoid internal contamination. As a further example, the knife may include a two-piece assembly housing held together by security screws requiring specialized tooling to access the interior of the assembly housing, thereby preventing or minimizing internal contamination and malfunction. As yet a further example, the knife may limit a depth of cut of a blade of the knife in a rigid or semi-rigid workpiece by limiting extension of the blade from the knife. As another example, the knife may limit a depth of cut of a blade of the knife in a rigid or semi-rigid workpiece through an external guide. As yet another example, the knife may ensure a substantially straight cut of a rigid or semi-rigid workpiece through an external guide. As a further example, the knife may allow a user to more comfortably cut rigid or semi-rigid material without substantially injury. As another example, the knife may be actuated with approximately 75% less force than typical knives.

These general and specific aspects may be implemented using a device, system or method, or any combinations of devices, systems, or methods. The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1A:
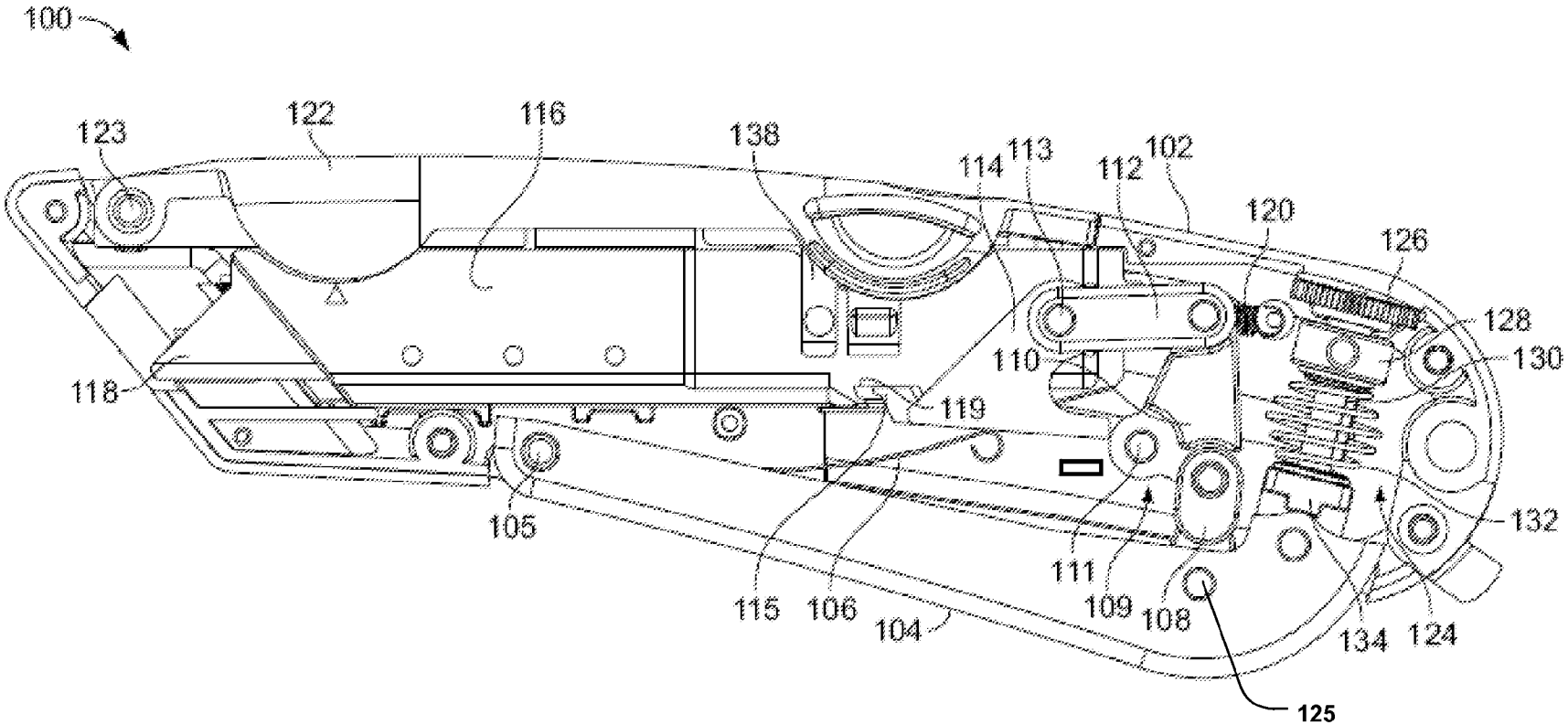
FIGS. 1A-C illustrate one implementation of a knife described in the present disclosure with the knife in various positions.
Figure 1B:
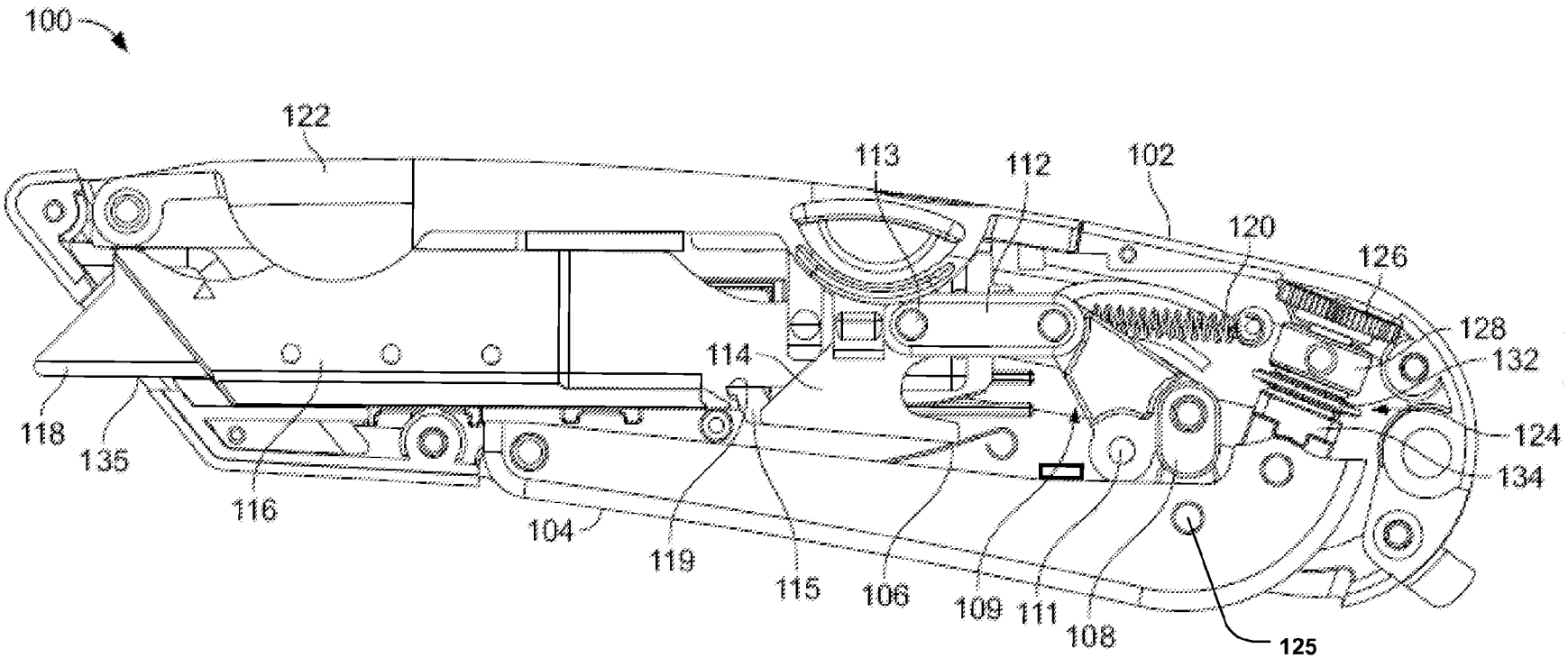
Figure 1C:
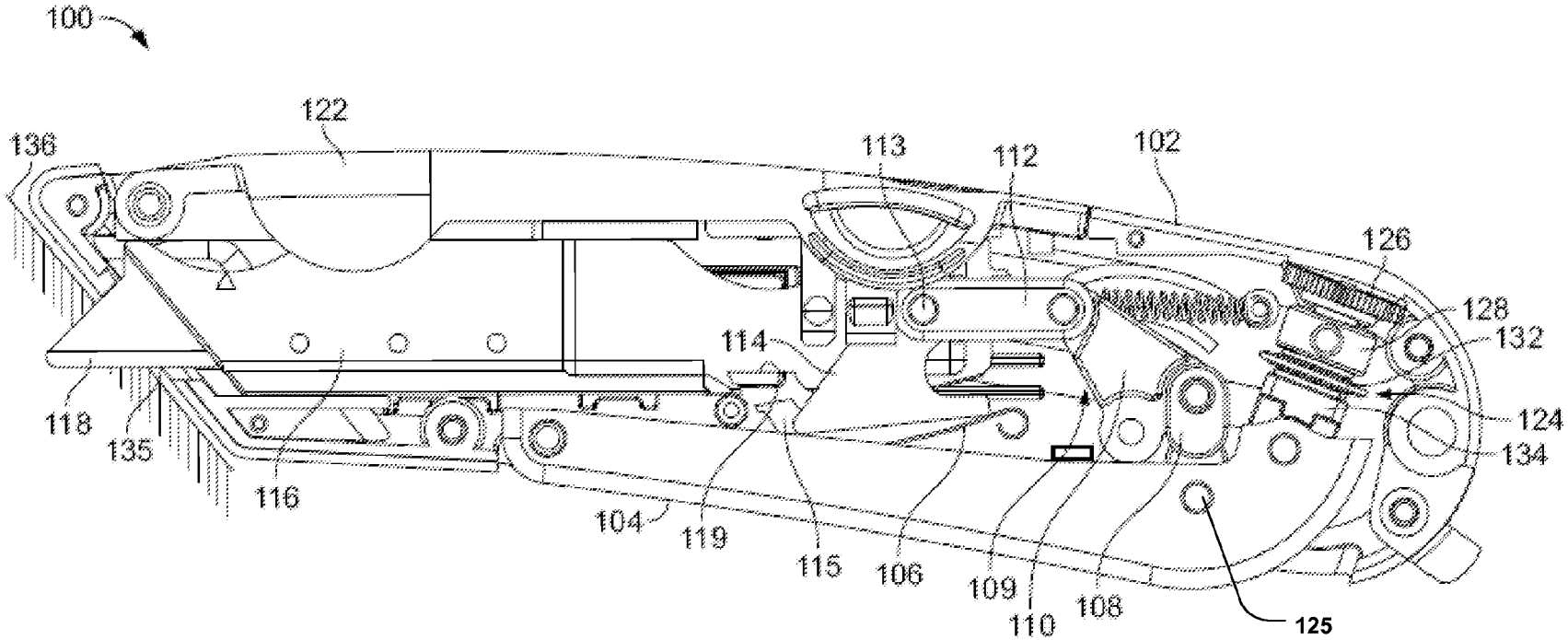

FIGS. 1A-C illustrate a knife 100, which may be used to cut rigid or semi-rigid materials, such as, for example, corrugated board, cardboard or other paper products, rubber, plastic Styrofoam, or any other appropriate material. The knife 100, generally, is a handheld device operated by either a left-handed or right-handed user with equal ease. In some implementations, the knife 100 allows the user to select a blade position, which controls an extension length of the blade from the handle of the knife 100. For example, in some aspects, the user may select one of three different blade positions. Regardless of the selected position, the knife 100 allows the user to actuate a trigger, thereby extending the blade from the knife handle so that the blade can engage a piece of material. Once the user finishes cutting the material as desired, the user may disengage the blade from the material. Once disengaged, the blade is automatically retracted within the knife handle by a tension spring, thereby ensuring that the blade is no longer exposed and able to cause injury to the user or other person, and/or the material previously cut. This automatic retraction of the blade may occur from any of the selected positions. Further, this automatic retraction of the blade occurs regardless of whether the knife trigger is in an actuated or non-actuated position.

More specifically, FIGS. 1A-C illustrate one implementation of the knife 100 in various positions of operation and non-operation. With reference to FIG. 1A in particular, the knife 100 is illustrated in a rest, or safe, position. Knife 100, generally, includes a handle consisting of two handle sub-assemblies 102, a trigger 104, a leaf spring 106, a blade transmission 109, a blade shuttle 116, a blade 118, a shuttle spring 120, and a position assembly 124. In the safe position, the blade is completely retracted or substantially retracted within the handle of the knife 100. For illustrative purposes only, FIGS. 1A-C show a single handle sub-assembly 102. Another handle sub-assembly 102 may be coupled to the illustrated handle sub-assembly 102 to enclose the various parts of the knife 100. For example, in some aspects, the handle sub-assemblies 102 are coupled together with adhesive or mechanical fasteners, such as security screws. Such security screws (not shown) may require a unique tool for access to the internal mechanism of the knife 100. Further, in some implementations, the handle sub-assembly 102 may include integral guide ribs (not shown) positioned to guide a movement and a rotation of the lever 114.

Handle sub-assembly 102 may include several protrusion pins onto which various parts of the knife may be coupled. For example, trigger 104 is pivotally coupled to the handle sub-assembly 102 at a trigger mount pin 105 and is also coupled to the position assembly 124. Trigger 104 is further coupled to the blade transmission 109 via a linkage 108, with a pin 125 coupling the trigger 104 to the linkage 108. The trigger 104, generally, extends to an exterior of the handle sub-assemblies 102 and provides an ergonomic element to activate the knife 100 and extend the blade 118. Although illustrated as an elongated and rounded element, the trigger 104 may be any appropriate shape. In the safe position, the trigger 104 is fully extended from the coupled handle sub-assemblies 102.

At least a portion of the leaf spring 106 is substantially enclosed within a hollow portion of the trigger 104. The leaf spring 106 fits around the trigger mount pin 105 within the hollow cavity of the trigger 104. In the safe position illustrated in FIG. 1A, the leaf spring may exert no pressure or substantially no pressure on a lever 114, and thus, may only contact the lever 114. In some aspects, the leaf spring 106 may produce a constant force on the lever 114 in all positions of the knife 100.

Blade transmission 109 is coupled to the trigger 104 through the linkage 108 and, in some aspects, may include a clevis 110, one or more links 112, and the lever 114. Generally, when actuated, the blade transmission 109 translates a movement according to a first direction of at least a portion of the trigger (for instance a substantially vertical movement of the trigger 104) to a movement of the blade shuttle 116 according to a second direction transverse to the first direction (for instance a substantially horizontal movement of the blade shuttle 116). This may allow the blade shuttle 116, including the blade 118, to be driven forward within the knife 100, as described in more detail with respect to FIG. 1B. The clevis 110 is coupled to the trigger 104 via the linkage 108 and is also pivotally coupled to at least one handle sub-assembly 102 by a clevis mount pin 111. The clevis 110 is also pivotally coupled to at least one link 112. In some aspects, the clevis 110 includes a substantially hollow channel portion through which a shuttle spring 120 may fit through. Further, in some implementations, the clevis 110 is coupled to two links 112, with the links 112 positioned on and coupled to either side of the clevis 110.

The links 112 couple the clevis 110 to the lever 114. Lever 114, in some aspects, is a toggle component including a substantially hollow channel portion that allows the blade shuttle 116 to move laterally through the lever 114. The lever 114 may, in some aspects, include a pin 113 located on either side of the lever 114 to couple the lever 114 to one or more links 112. Further, each pin 113 may, in some aspects, fit into the substantially horizontal guide ribs (not shown) formed on the interior walls of adjacent handle sub-assembly 102. The lever 114 also may include a notch 115 that may fit within a cut-out of the blade shuttle 116 and, as shown in more detail in FIG. 1B, may provide a location for force and movement to be transferred from the lever 114 to the blade shuttle 116.

The blade shuttle 116, as shown in the rest, or safe, position in FIG. 1A, is fully contained within the handle sub-assembly 102. The blade 118 may be semi-permanently secured within the blade shuttle 116 at a front end of the shuttle 116. A back end of the shuttle 116 fits within the hollow channel of the lever 114 and is coupled to the shuttle spring 120. For example, in some aspects, the blade shuttle 116 may include a small aperture through which the shuttle spring 120 may be hooked or otherwise fastened. In various aspects, the blade shuttle 116 may also include one or more radial ribs 117 (illustrated in FIG. 2). The radial ribs 117 may be formed into the blade shuttle 116 on either side of the shuttle 116 and act as stops to limit the movement of the lever 114. Further, the radial ribs 117 may allow for the lever 114 to more easily rotate about the pins 113. In some aspects, the radial ribs 117 may allow the notch 115 of the lever 114 to move approximately 0.028 inches to engage and release the blade shuttle 116 within the receptive opening 119 of the blade shuttle 116.

The blade shuttle 116 includes a receptive opening 119 on the lower edge of the shuttle 116, which accepts the notch 115 of the lever 114 upon forward movement of the lever 114, described in more detail in FIG. 1B. In some aspects, a contour of the receptive opening 119 may be substantially similar to a contour of the notch 115, thereby allowing for little clearance and ensuring fit between the notch 115 and opening 119.

The blade 118 fits within the blade shuttle 116 and may be secured or fastened to the blade shuttle, or in some aspects, may freely rest within the blade shuttle 116. Although illustrated in FIG. 1A as a straight blade with a substantially horizontal cutting edge, the blade 118 may be any type of cutting or slicing blade as appropriate. For example, blade 118 may, in some implementations, include a serrated edge for a sawing effect. Further, in some aspects, the blade 118 may include a hooked end.

Figure 6:
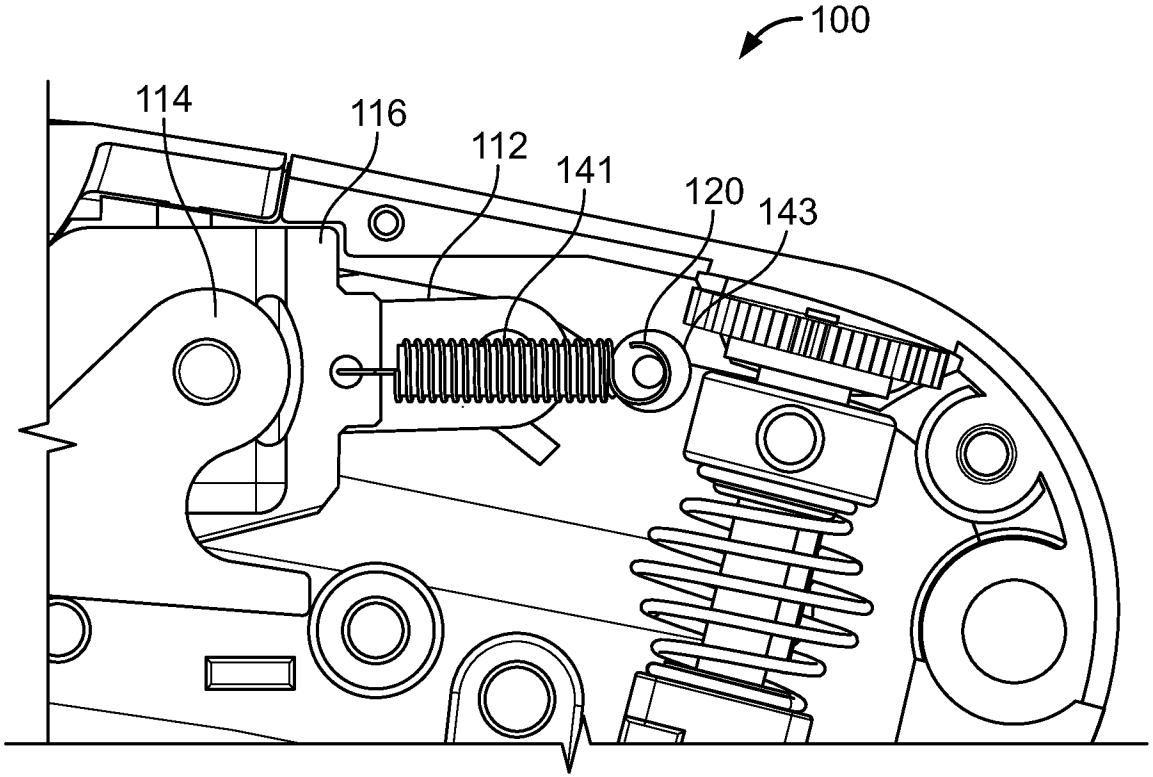
FIG. 6 illustrates one implementation of a blade retracting mechanism described in the present disclosure.

The shuttle spring 120 is coupled between a protrusion of the handle sub-assembly 102 and the blade shuttle 116. Shuttle spring 120, generally provides a spring force on the blade shuttle 116 in the opposite direction of the location of the blade 118. In some aspects, the shuttle spring 120 may exert no or substantially no spring force on the blade shuttle 116 in the rest, or safe, position of the knife 100. Turning particularly to FIG. 6, a more detailed illustration of the shuttle spring 120 is shown. Shuttle spring 120 is coupled to the handle sub-assembly 102 at a spring pin 143 via a rounded hook that catches on the pin 143. Shuttle spring 120 is coupled to the blade shuttle 116 at a pinhole in the shuttle 116. As noted previously, the shuttle spring 120 may exert no or substantially no spring force on the blade shuttle 116 in the rest, or safe, position of the knife 100. A limit pin 141 may be inserted within the shuttle spring 120 thereby providing a minimal clearance between the shuttle spring 120 and an edge of the pinhole of the blade shuttle 116. In such a fashion, the shuttle spring may experience a "no load" state while the knife 100 is in the rest, or safe, position.

Figure 2:
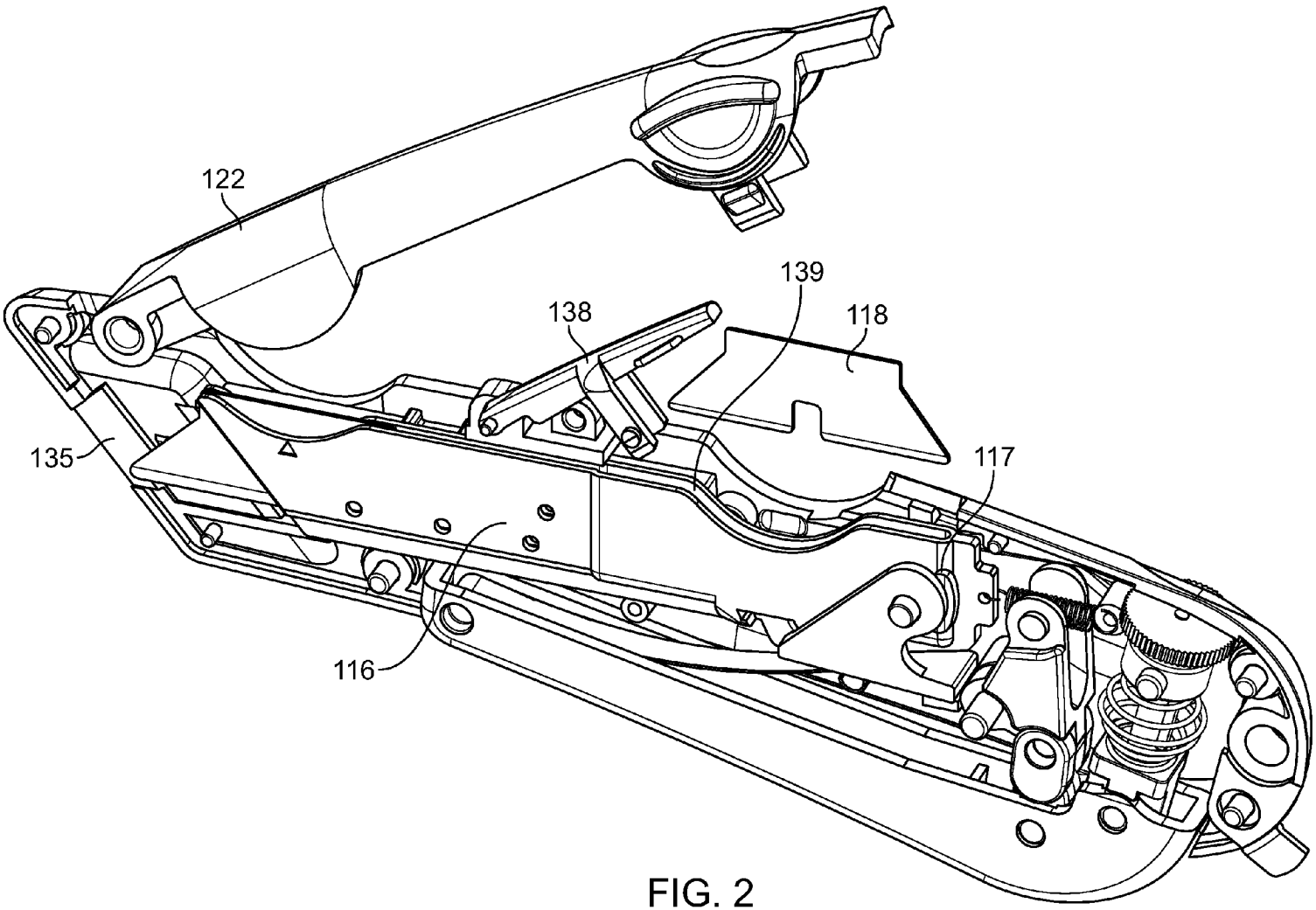
FIG. 2 illustrates one aspect of a knife described in the present disclosure including a spare blade holder.

Returning to FIG. 1A, a cover 122 is pivotally coupled to at least one handle sub-assembly 102 at cover pin 123. The cover 122, generally, provides access to the blade shuttle 116 so that, for example, the blade 118 may be replaced or an inspection may be made of the blade 118 for wear and tear. Turning briefly to FIG. 2, an isometric view of the knife 100 is illustrated, showing the cover 122 and a blade cover 138 each in an open position. The blade cover 138, in some aspects, may also be pivotally coupled to at least one handle sub-assembly 102. Further, the blade cover 138, when in the open position, may allow access to the blade shuttle 116 and, more particularly, a spare blade receptacle 139. The spare blade receptacle 139 may store one or more blades 118. As illustrated in FIG. 2, the spare blade receptacle 139 may be integral to the blade shuttle 116. In some implementations of the knife 100, however, the spare blade receptacle may be formed from a portion of the handle sub-assembly 102 or located in any appropriate place within the knife 100.

Returning to FIG. 1A, the knife 100 includes a position assembly 124. Position assembly 124 is coupled to the trigger 104 and, in some aspects, includes a dial 126, a bushing 128, a stem 130, a barrel spring 132, and a base 134. The position assembly 124, generally, allows a user of the knife 100 to select one or more extended positions of the blade 118 when the trigger 104 is actuated. For example, a particular position that the user may select may provide for the blade 118 to extend from the blade aperture 135 (shown in more detail in FIG. 2) an appropriate length to cut single wall corrugated board. Further, a second position may provide for the blade 118 to extend from the blade aperture 135 an appropriate length to cut twin wall corrugated board. Even further, a third position may provide for the blade 118 to extend from the blade aperture 135 an appropriate length to cut triple wall corrugated board. More selectable positions may be utilized as appropriate.

Figure 5:
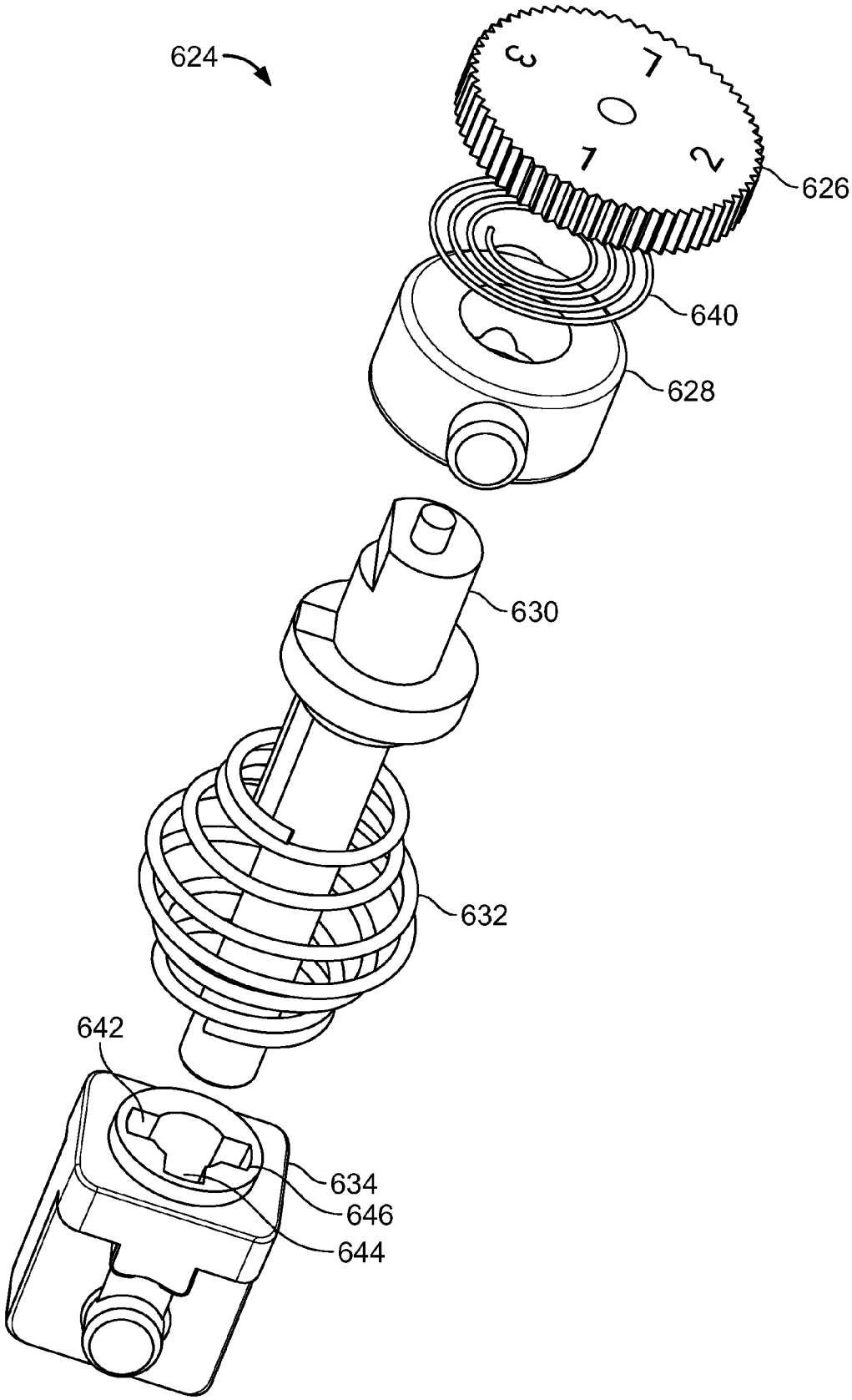
FIG. 5 illustrates one implementation of a position selection assembly described in the present disclosure.

Turning particularly to FIG. 5, one implementation of a position assembly 624 is illustrated. Position assembly 624 may be utilized in the knife 100 in place of position assembly 124 and includes components which may be substantially similar to those included in the position assembly 124. Position assembly 624 includes a dial 626, a bushing 628, a stem 630, a barrel spring 632, a base 634, and a dial spring 640. The dial 626, typically, is externally accessible through one or more handle sub-assemblies 102 and provides a user of the knife 100 one or more position selections to choose from. As illustrated in FIG. 5, dial 626 includes three position selections in addition to a lock or "L" position. In the lock position, the trigger 104 may not be actuated, thereby preventing the blade 118 from extending through the blade aperture 135. The three position selections labeled "1," "2," and "3" may provide for three different positions to which the blade 118 may be extended through the blade aperture 135 upon actuation of the trigger 104.

The dial 626 is coupled to the stem 630 via the bushing 628. In some aspects, an interior wall of the bushing 628 may include one or more recessed apertures, which may allow a detent on the dial 626 to be inserted. The apertures may vertically correspond to one or more positions of base seats 642, 644, and 646 described below. The dial spring 640 is located between the bushing 628 and the dial 626 and, generally, exerts a spring force against both the dial 626 and the bushing 628, thereby allowing or helping allow the dial 626 to maintain a particular position selection once made by the user. In some aspects, the dial spring 640 may be a wave spring or a washer spring. By rotating the dial 626 to a desired position selection, the stem 630 may be rotated concurrently. By selecting the "1," "2," or "3" with the dial 626, the keyed portion of the stem 630 may be vertically aligned with a particular base seat in the base 634.

The stem 630, as shown in FIG. 5, includes a keyed portion along a substantially vertical and cylindrical portion. In some implementations, the stem 630 may be made of metal, such as stainless or ferrous steel, titanium, or aluminum. Further, in some aspects, the stem 630 may be plastic-coated steel. For example, a plastic-coated steel stem 630 may experience minimal friction and wear when rotating within the base 634, which, in some aspects, may be made of steel.

The base 634, as illustrated in FIG. 5, includes three base seats labeled 642, 644, and 646. For example, base seat 642 may be aligned with the keyed portion of the stem 630 at position selection "3," base seat 644 may be aligned with the keyed portion of the stem 630 at position selection "1," and base seat 646 may be aligned with the keyed portion of the stem 630 at position selection "2." Each base seat in the base 634 may extend into the base 634 a particular depth, thereby allowing the stem 630 to protrude into the base 634 at different depths depending on the position selection. For example, the base seat 646 may be deeper than the base seat 644. Therefore, the stem 630 may extend further into the base 634 upon actuation of the trigger 104 when the position selection "2" is selected on the dial 626 than when the position selection "1" is selected on the dial 626.

Figure 7:
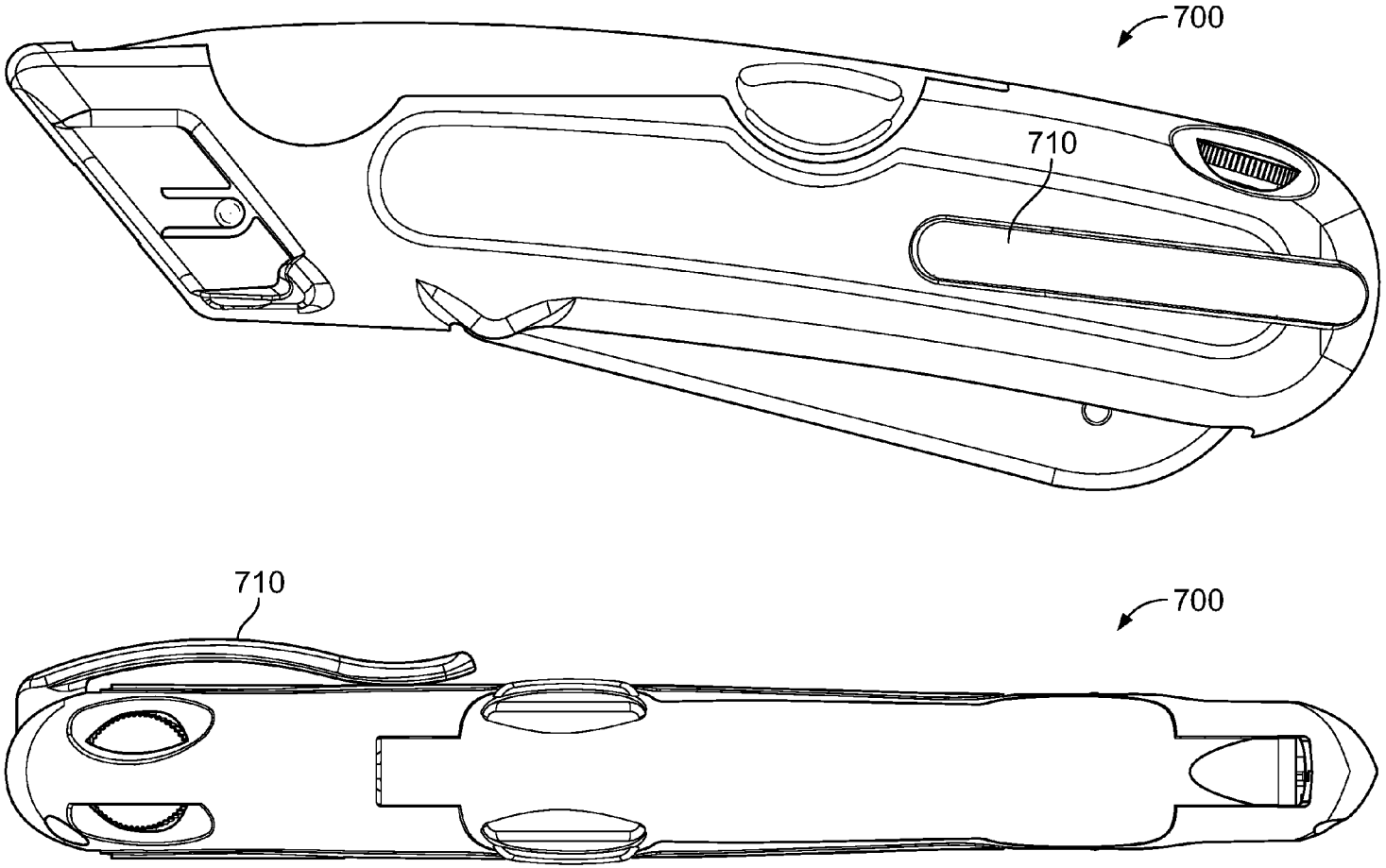
FIG. 7 illustrates another implementation of a knife as described in the present disclosure.

With reference to FIG. 7, another implementation of a knife 700 is illustrated, including a handle clip 710. In some aspects, the knife 700 may be substantially similar to the knife 100 as described with reference to FIGS. 1A-C. Handle clip 710, generally, may provide a user of the knife 700 a mechanism to attach the knife 700 to a belt, tool belt, clothing portions, toolbox, or other locations as appropriate during periods of non-use of the knife 700. Handle clip 710 may, in some implementations, rotate about an axis perpendicular to the longitudinal dimension of the knife 700 to allow for easier fastening to, for example, the user's belt or clothing. Further, handle clip 710 may be detachable from and re-attachable to the knife 700 as needed.

Returning to FIG. 1A, in some aspects of the knife 100, four independent springs may be utilized to, for example, reduce an amount of force required by a user to actuate the knife 100 into a cutting position. For instance, as shown in FIGS. 1A and 5, the knife 100 includes the leaf spring 106, the shuttle spring 120, the barrel spring 132, and, with reference to FIG. 5 particularly, the dial spring 640. Each spring may accomplish distinct functions and, in some aspects, operate independently to actuate the knife 100 from the rest position to the cutting position. Further, at least some of the springs 106, 120, 132, and 640 may allow the user to apply a substantially constant fore to actuate the trigger 104 and maintain the trigger 104 in the actuated position while the blade 118 engages and disengages a piece of rigid or semi-rigid material. In some aspects, the force required to actuate the knife 100 may be between approximately 4 ounces and approximately 10 ounces.

For example, the leaf spring 106 may hold the blade shuttle 116 attachment to the trigger 104 to allow the user to actuate the trigger 104 to engage the blade 118 to multiple extension distances. Further, as described more fully with reference to FIG. 1C, the leaf spring 106 may act like a "see-saw." Once the blade 118 is engaged in the material, a contact point between the leaf spring 106 and the lever 114 moves behind a vertical center line of a pin 113, which may rotate the lever 114 and allow decoupling of the lever 114 from the blade shuttle 116. As the blade shuttle 116 returns from an extended position to its rest position, the contact point between the leaf spring 106 and lever 114 moves forward of the vertical centerline of the pin 113, thereby allowing the lever 114 to rotate and re-engage the blade shuttle 116. The trigger 104 may then be actuated again as needed.

In certain implementations, the shuttle spring 120 may act only to retract the blade shuttle 118 when the blade becomes disengaged from the material. For example, as the trigger 104 is actuated, the shuttle spring 120 increases a retraction force applied to the blade shuttle 116. This force may act to return the blade shuttle 116 to its rest position.

In some aspects of the knife 100, the barrel spring 132, as one portion of the position assembly 124, functions to keep the blade shuttle 116 and the trigger 104 ready to extend the blade 118 when the trigger 104 is actuated.

With particular reference to FIG. 5, the dial spring 640 may act without influence on the leaf spring 106, the shuttle spring 120, and the barrel spring 132. The dial spring 640 may, in some aspects, function only to retain the dial 626 in a selected position.

FIG. 1B illustrates one implementation of the knife 100 in an actuated position. In order to adjust the knife 100 from the rest, or safe, position as shown in FIG. 1A to the actuated position, the operator compresses the trigger 104. The trigger 104 compresses until the position assembly 124 limits compression. For example, as described with reference to FIG. 5, compression will be limited according to the position selection chosen and the depth of the base seat to which the stem 630 may protrude into the base 634. Compression of the trigger 104 may apply a vertical movement on the linkage 108, which may translate to the clevis 110. The clevis 110 may rotate about the clevis mount pin 111, thereby translating the substantially vertical movement of the linkage 108 to a substantially horizontal movement of the link or links 112. The link 112, coupled to the lever 114 at the lever pin 113, pushes the lever 114 forward such that the notch 115 on the lever 114 is inserted into the receptive opening 119 of the blade shuttle 116.

Upon compression of the trigger 104 by the operator of the knife 100, the leaf spring 106 may apply an upward force on the lever 114 as a contact point of the leaf spring 106 to the lever 114 moves toward the vertical centerline of the lever pin 113. As the notch 115 of the lever 114 engages the receptive opening 119 of the blade shuttle 116, the blade shuttle 116 is pushed from its rest position to its actuated position. The distance from the rest position to the actuated position of the blade shuttle 116 is related to the position selection chosen on the dial 126. As the blade shuttle 116 moves from the rest position to the actuated position, the shuttle spring 120 extends and applies a spring force opposite the direction of movement of the blade shuttle 116, thereby urging the blade shuttle 116 into its rest position.

As the blade shuttle 116 is moved from the rest position to the actuated position, the blade 118 extends through the blade aperture 135 from a rest position to an extended position. The distance that the blade 118 extends through the blade aperture 135 may depend on the position selection chosen by the user of the knife 100. For example, a position selection of "3" selected on the dial 126 may provide for the blade 118 to be extended a distance through the blade aperture 135 allowing the blade 118 to cut triple-wall corrugated board. A position selection of "2" selected on the dial 126, however, may provide for the blade 118 to be extended a shorter distance through the blade aperture 135.

The blade shuttle 116, in some aspects, may interact with the handle sub-assembly 102 to help stabilize the blade 118 and limit a transverse movement of the blade 118 as the blade 118 protrudes through the blade aperture 135. For example, when two handle sub-assemblies 102 are coupled together, the blade aperture 135 may create a "pinch point," thereby compressing a front end of the blade shuttle 116 where the blade 118 is located. In some aspects, this "pinch point" may help limit transverse movement of the blade 118 within the blade aperture 135 to, for example, 0.007 inches. In such aspects, the blade shuttle 116 may include a front end which is radiused so that, upon retraction, the blade shuttle 116 does not catch within the "pinch point."

Turning now to FIG. 1C, a cutting position of one implementation of the knife 100 is illustrated. Once actuated, the knife 100 may be used to cut a material, such as a workpiece 136. As the blade 118 is inserted into the workpiece 136 and begins to cut or slice the workpiece 136, a friction force is placed on the blade 118 by the workpiece 136 and the cutting movement of the blade 118. This friction force is directed substantially horizontal and opposite to the spring force of the shuttle spring 120. The shuttle spring 120, in some aspects, may be selected such that the spring force of the spring 120 is slightly less than the friction force applied to the blade 118. In such aspects where the friction force is greater than the spring force applied to the blade shuttle 116 by the shuttle spring 120, the blade 118 and blade shuttle 116 are extended an additional fixed distance from their respective actuated positions. In some aspects, this extension may be approximately 0.028 inch.

Upon extension, the lever 114 rotates to release the notch from the receptive opening 119 of the blade shuttle 116. Rotation of the lever 114 in a counterclockwise direction to release the notch from the opening 119 may also be facilitated due to the location of the contact point between the leaf spring 106 and the lever 114 when the blade 118 is extended moving behind the vertical centerline of the pin 113. As the contact point moves behind the vertical centerline of the pin 113, the notch may be forcibly decoupled from the receptive opening 119.

Once the notch is uncoupled from the opening 119, the blade shuttle 116 is free to return to its rest position once the blade 118 becomes disengaged from the workpiece 136. The friction force applied to the blade 118 retains the blade 118 in the workpiece 136. Upon completion of the cut, the spring force of the shuttle spring 120 automatically retracts the blade shuttle 116, and thus the blade 118, into their respective rest, or safe, positions within the handle sub-assembly 102 of the knife 100. Automatic retraction of the blade shuttle 116 and the blade 118 may occur regardless of whether the trigger 104 remains in the actuated position and regardless of the position selection chosen by the user. The knife 100 may then be re-actuated as needed by the user.

Figure 3A:
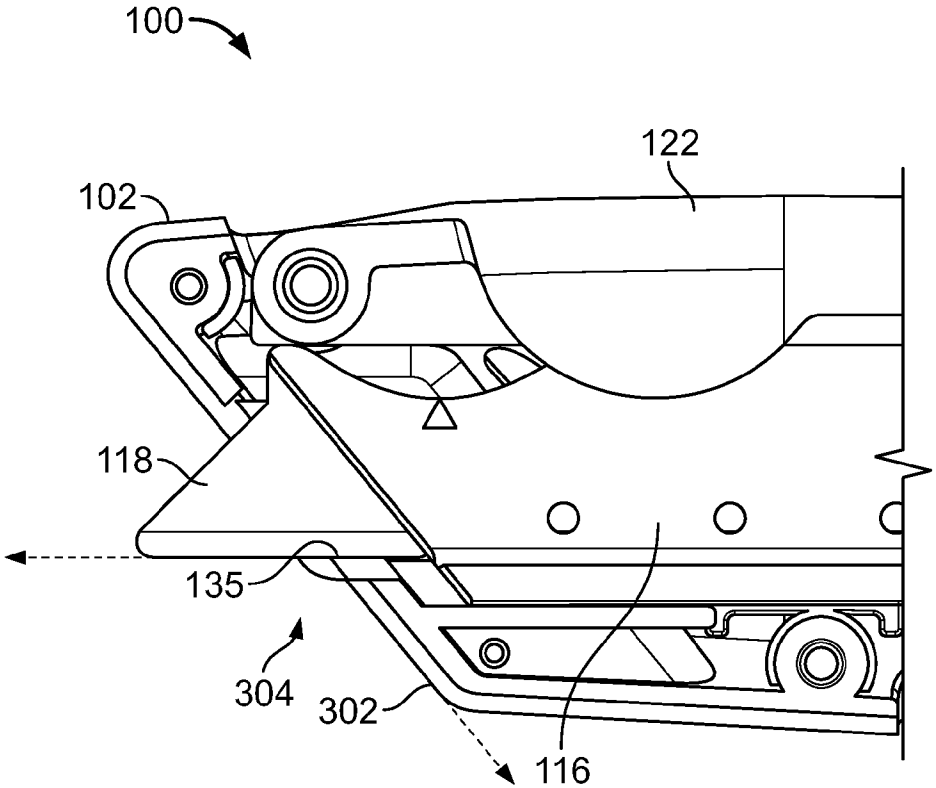
FIGS. 3A-B illustrate two views of a front edge portion of one implementation of a knife described in the present disclosure.
Figure 3B:
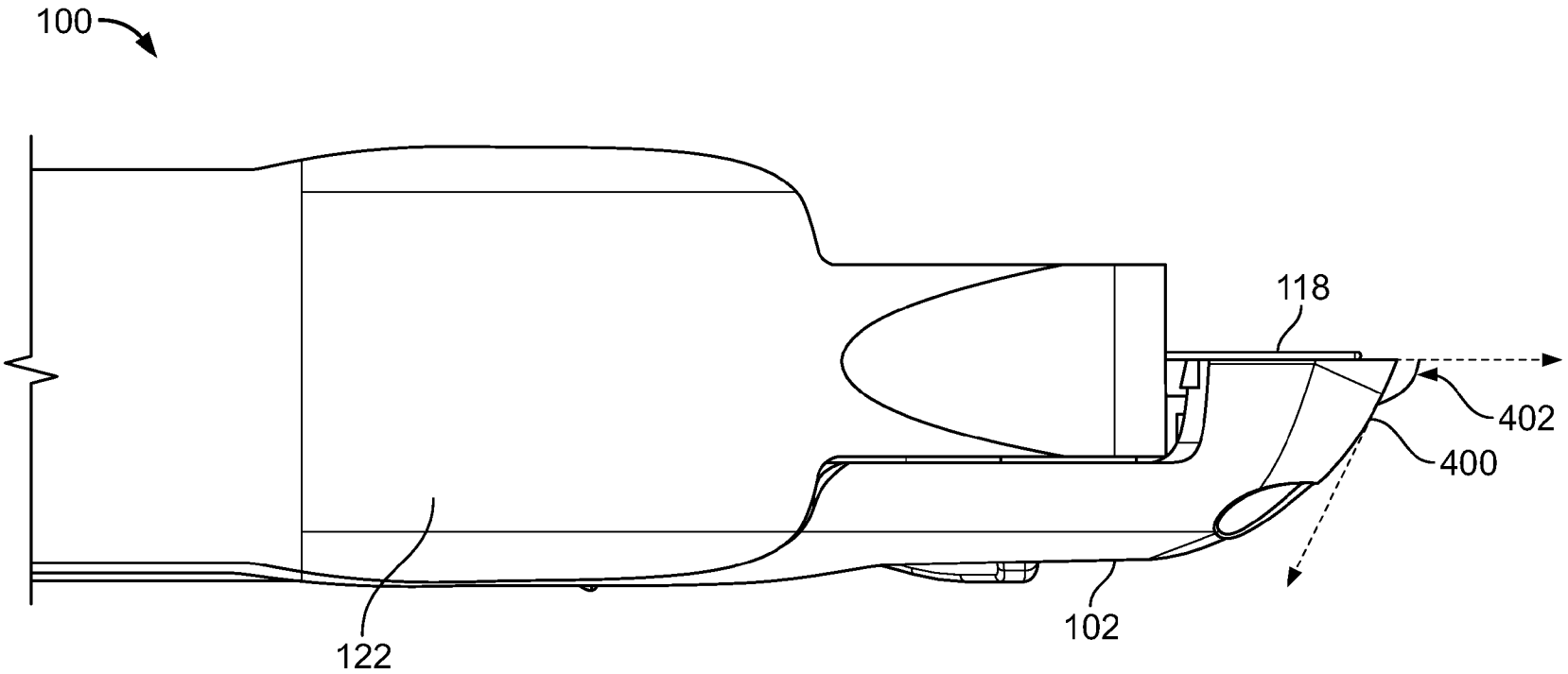

FIGS. 3A-B illustrate two views of a front edge portion of one implementation of a knife, such as the knife 100 as described in FIGS. 1A-C. FIGS. 3A-B illustrate the knife 100 in the actuated position with the blade 118 extended through the blade aperture 135. In some aspects, the knife 100 may include a cutting edge 302, which creates a first cutting angle 304 with a sharpened edge of the blade 118. The first cutting angle 304, as shown in FIG. 3A particularly, may be an obtuse angle (e.g., greater than 90 degrees). Turning particularly to FIG. 3B, the knife 100 may also include a handle contour 400, which creates a second cutting angle 402 between an extension plane of the blade 118 and the handle contour 400. The second cutting angle 402, as shown in FIG. 3B, may also be an obtuse angle (e.g., greater than 90 degrees). Taken together, the first cutting angle 304 and the second cutting angle 402 may create a compound angle of cut of the blade 118, thus allowing the blade 118 to more easily slice a material, such as the workpiece 135. In some aspects, the compound angle of cut may reduce the energy and labor required to make a cut with the knife 100 by, for example, providing a falling edge such that cut material may more easily be removed and fall off the edge.

Figure 4:
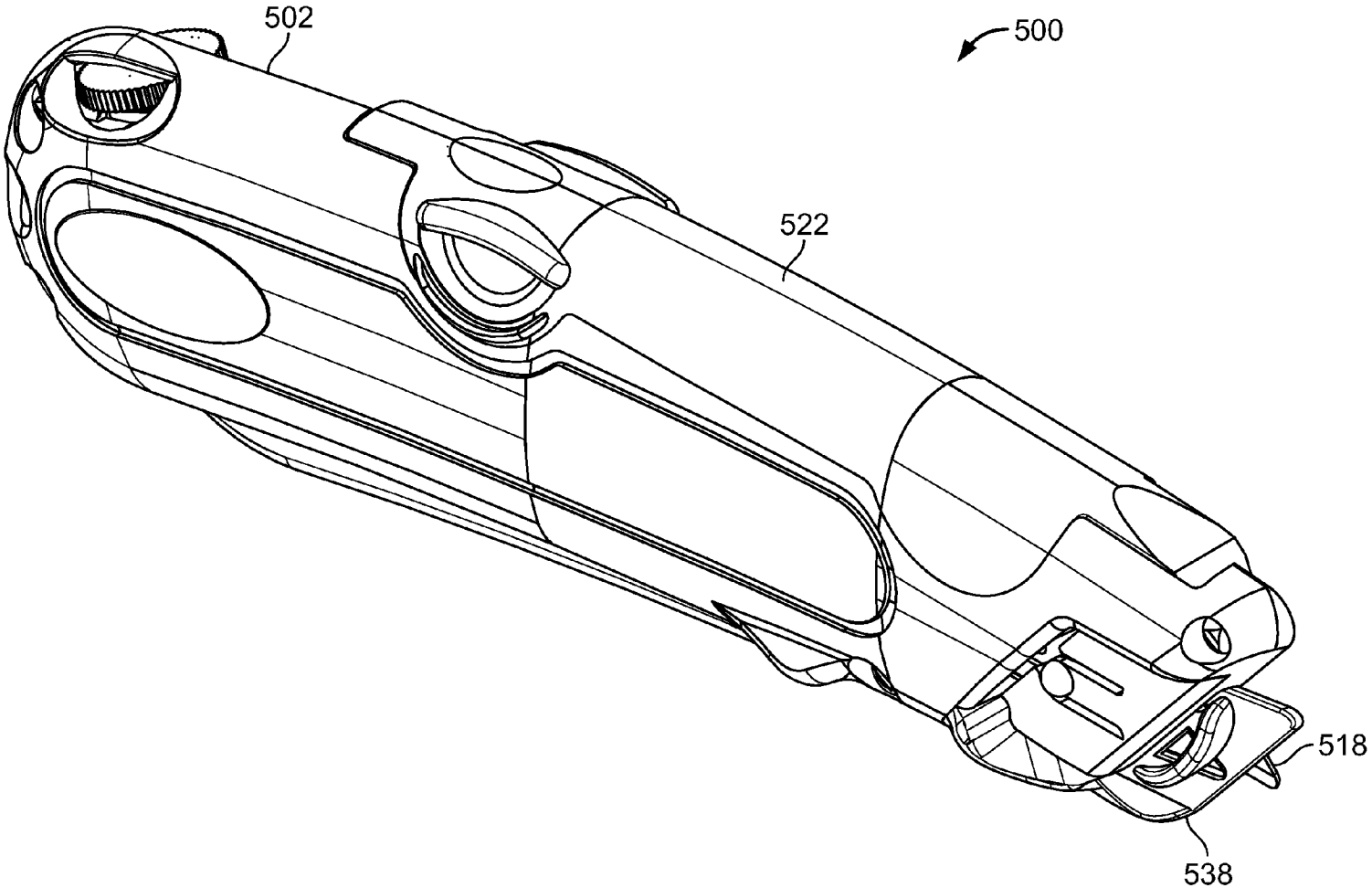
FIG. 4 illustrates one aspect of a knife described in the present disclosure including a blade guide.

FIG. 4 illustrates one aspect of a knife 500 described in the present disclosure including a blade guide 538. In some aspects, the knife 500 including the blade guide 538 may be substantially similar to the knife 100 illustrated in FIGS. 1A-C. Knife 500 also includes a blade 518, a cover 522, and at least one handle sub-assembly 502. These components may be substantially similar to the blade 118, the cover 122, and the handle sub-assembly 102 shown in FIGS. 1A-C. The blade guide 538, as illustrated in FIG. 4, may be an integral part of the handle sub-assembly 502. In some aspects, however, the blade guide 538 may be a separate part that is detachably secured to the handle sub-assembly 502 and may be removed by the user. In other aspects, the knife 500 may include two blade guides 538 with one located on either side of the knife 500. The blade guide 538, as shown, may be extended a desired distance past a front edge of the handle sub-assembly 502. This distance may, in some aspects, correspond to a distance from which the blade 518 extends from the handle sub-assembly 502. The blade guide 538 also, in some aspects, may include a contoured shape which substantially matches the front edge contour of the handle sub-assembly 502. Upon actuation of the blade 518 and insertion of the blade 518 into a material to be cut, the blade guide 538 may guide a cutting movement of the blade 518 along a substantially straight path, thereby allowing the user to make a straight or substantially straight cut in the material. In some implementations, as shown in FIG. 4, the blade guide 538 may include a raised ridge to allow the user to more easily extend the blade guide 538 from the handle sub-assembly 502.

Certain implementations of the knife 500 may include a trigger substantially similar to the trigger 104 shown in FIGS. 1A-C. In some aspects, the trigger 104, in an actuated position, may lock the blade guide 538 into the extended position. For example, the user may manually extend the blade guide 538 and then actuate the trigger 104. Once actuated, the trigger 104 may lock the blade guide 538 into the extended position such that the blade guide 538 may not be pushed back into its non-extended position until the trigger 104 is returned to a non-actuated position.

Continuing with FIG. 4, the blade guide 538, in some aspects, may slideably engage within the handle sub-assembly 502 and secure within the handle sub-assembly 502 on one or more integral protrusions (not shown) on the interior wall of the handle sub-assembly 502. In some aspects, while a user is cutting a rigid or semi-rigid material, such as described with reference to FIG. 1C, the user may extend the blade guide 538 from the handle sub-assembly 502. For instance, when cutting open a top of a corrugated box, the user may extend the blade guide 538 such that it moves across a top surface of the box as the user cuts the corrugated material. When in contact with the top surface of the box during the cutting procedure, the blade guide 538 may direct the knife 500 such that the second cutting angle 402 (described with reference to FIG. 3B) is properly utilized (e.g., the handle contour 400 slideably contacts a side surface of the corrugated box during the cutting procedure). In such aspects, the blade guide 538 may help ensure a friction created between the blade 518 and the corrugated material is minimized, thus reducing the energy required by the user to complete the cutting procedure.

A number of implementations have been described. Nevertheless, it will be understood that various modifications may be made. Accordingly, other implementations are within the scope of the following claims.

What is claimed is:

1. A knife, comprising:

a handle enclosing at least a portion of one or more of a blade, a blade shuttle, a transmission, and a trigger, the handle comprising a blade aperture;

the blade shuttle longitudinally moveable relative to the handle from a rest position to a first extended position and from the rest position to a second extended position, the first extended position differentiated from the second extended position, the blade shuttle moveable longitudinally from the first extended position and the second extended position to a cutting position when the blade is engaged in a workpiece, the knife configured such that the blade shuttle is automatically retracted from the cutting position to the rest position when the blade is disengaged from the workpiece;

the blade secured within the blade shuttle, a distal end of the blade protruding a first distance from the blade aperture at the first extended position and a second distance from the blade aperture at the second extended position, the first distance differentiated from the second distance, the knife configured such that when the distal end of the blade protrudes the first distance from the blade aperture, the distal end of the blade moves to a distance from the blade aperture greater than the first distance from the blade aperture when the blade is engaged in the workpiece, and when the distal end of the blade protrudes the second distance from the blade aperture, the distal end of the blade moves to a distance from the blade aperture greater than the second distance from the blade aperture when the blade is engaged in the workpiece, the knife configured such that the blade is automatically retracted to a safe position within the handle when the blade is disengaged from the workpiece; and the trigger adapted to drive the blade shuttle from the rest position to the first extended position and from the rest position to the second extended position via the transmission, the blade shuttle is in a fully extended position relative to the rest position in both the first and second extended positions; and a position selector interposed between the handle and the trigger and adapted to limit a trigger stroke relative to the handle so as to drive the blade shuttle to one of the first extended position and the second extended position, the position selector comprising:

a stem;

a base comprising a first seat and a second seat; and a dial accessible to an exterior of the handle and coupled to the stem, the dial adapted to rotate the stem to a first position selection and a second position selection, the stem adapted to protrude into the first seat at the first position selection upon a first actuation of the trigger and the second seat at the second position selection upon a second actuation of the trigger, the blade adapted to protrude the first distance through the blade aperture at the first position selection upon the first actuation of the trigger and the second distance through the blade aperture at the second position selection upon the second actuation of the trigger.

2. The knife of claim 1, the transmission comprising:

a lever;

a first spring operatively coupled to the trigger, the first spring adapted to:

direct the lever to engage the blade shuttle in the first extended position and the second extended position; and rotate the lever to disengage the lever and the blade shuttle in the cutting position;

a second spring operatively coupled to the handle and the blade shuttle, the second spring adapted to automatically retract the blade shuttle from the cutting position to the rest position.

3. The knife of claim 2, wherein the second spring exerts no force on the blade shuttle in the rest position.

4. The knife of claim 2, wherein the knife further comprises at least a third spring adapted to act between the handle and the trigger and cooperate with the first and second springs to maintain a substantially constant force magnitude required to actuate the trigger and maintain the trigger in the actuated position.

5. The knife of claim 4, wherein the third spring is adapted to act between the handle and the trigger and cooperate with the first and second springs to maintain a substantially constant force magnitude required to actuate the trigger and maintain the trigger in the actuated position upon the blade engaging the workpiece.

6. The knife of claim 4, the force magnitude being between approximately 4 ounces and approximately 10 ounces.

7. The knife of claim 1, the knife further configured such that the blade shuttle is automatically refracted from the cutting position to the rest position when the blade is disengaged from the workpiece with the trigger in the actuated position.

8. The knife of claim 1, wherein the distance from the distal end of the blade to the blade aperture is approximately 0.028 inches greater than the first distance from the blade aperture when the blade is engaged in the workpiece.

9. The knife of claim 1, the blade shuttle moveable longitudinally from the rest position to a third extended position, the third extended position differentiated from the first and second extended positions, the blade shuttle moveable longitudinally from the third extended position to the cutting position when the blade is engaged in the workpiece.

10. The knife of claim 1, wherein the position selector is further adapted to limit the trigger to a lock position, the blade shuttle maintained at the rest position when the trigger is in the lock position.

11. The knife of claim 1, wherein the position selector further comprises a selector spring adapted to maintain the dial at a selected position.

12. The knife of claim 11, wherein the selected position comprises one of:

the first position selection;

the second position selection;

a third position selection; and a lock position.

13. The knife of claim 1, wherein the handle further comprises:

a front handle edge at the blade aperture, a plane tangential to the front handle edge and a plane tangential to the cutting edge of the blade defining a first obtuse angle; and a front contour, a plane tangential to the front contour and a plane tangential to the blade defining a second obtuse angle, the first obtuse angle and the second obtuse angle defining a compound angle of cut.

14. The knife of claim 13, wherein the knife further comprises a blade guide coupled to the handle, the blade guide adapted to direct a cut of the blade at the second obtuse angle.

15. The knife of claim 1, wherein the handle comprises a tapered terminal end at the blade aperture adapted to substantially constrain a movement of the blade transverse to a longitudinal dimension of the blade when the blade shuttle is in the cutting position.

16. The knife of claim 1, wherein the handle further comprises a longitudinally coupled two-piece handle assembly.

17. The knife of claim 1, wherein the blade shuttle comprises a spare blade receptacle and the knife further comprises:

a cover, at least a portion of the cover detachably secured to the handle to provide access to the blade; and a blade cover, at least a portion of the blade cover detachably secured to the handle to provide access to the spare blade receptacle.

18. The knife of claim 1, further comprising a handle clip.

19. A knife, comprising:

a handle enclosing at least a portion of one or more of: a blade, a blade shuttle, a transmission, and a trigger, the handle comprising:

a blade aperture;

a front handle edge at the blade aperture, a plane tangential to the front handle edge and a plane tangential to the cutting edge of the blade defining a first obtuse angle; and a front contour, a plane tangential to the front contour and a plane tangential to the blade defining a second obtuse angle, the first obtuse angle and the second obtuse angle defining a compound angle of cut;

the blade shuttle longitudinally moveable relative to the handle from a rest position to a first extended position and from the rest position to a second extended position, the first extended position differentiated from the second extended position, the blade shuttle moveable longitudinally from the first extended position and the second extended position to a cutting position when the blade is engaged in a workpiece, the knife configured such that the blade shuttle is automatically retracted from the cutting position to the rest position when the blade is disengaged from the workpiece;

the blade secured within the blade shuttle, a distal end of the blade protruding a first distance from the blade aperture at the first extended position and a second distance from the blade aperture at the second extended position, the first distance differentiated from the second distance, the knife configured such that when the distal end of the blade protrudes the first distance from the blade aperture, the distal end of the blade moves to a distance from the blade aperture greater than the first distance from the blade aperture when the blade is engaged in the workpiece, and when the distal end of the blade protrudes the second distance from the blade aperture, the distal end of the blade moves to a distance from the blade aperture greater than the second distance from the blade aperture when the blade is engaged in the workpiece, the knife configured such that the blade is automatically retracted to a safe position within the handle when the blade is disengaged from the workpiece; and the trigger adapted to drive the blade shuttle from the rest position to the first extended position and from the rest position to the second extended position via the transmission, the blade shuttle is in a fully extended position relative to the rest position in both the first and second extended positions; and a position selector interposed between the handle and the trigger and adapted to limit a trigger stroke relative to the handle so as to drive the blade shuttle to one of the first extended position and the second extended position.

20. A knife, comprising:

a handle enclosing at least a portion of one or more of: a blade, a blade shuttle, a transmission, and a trigger, the handle comprising a blade aperture;

the blade shuttle longitudinally moveable relative to the handle from a rest position to a first extended position and from the rest position to a second extended position, the first extended position differentiated from the second extended position, the blade shuttle moveable longitudinally from the first extended position and the second extended position to a cutting position when the blade is engaged in a workpiece, the knife configured such that the blade shuttle is automatically retracted from the cutting position to the rest position when the blade is disengaged from the workpiece, wherein the blade shuttle comprises a spare blade receptacle;

the blade secured within the blade shuttle, a distal end of the blade protruding a first distance from the blade aperture at the first extended position and a second distance from the blade aperture at the second extended position, the first distance differentiated from the second distance, the knife configured such that when the distal end of the blade protrudes the first distance from the blade aperture, the distal end of the blade moves to a distance from the blade aperture greater than the first distance from the blade aperture when the blade is engaged in the workpiece, and when the distal end of the blade protrudes the second distance from the blade aperture, the distal end of the blade moves to a distance from the blade aperture greater than the second distance from the blade aperture when the blade is engaged in the workpiece, the knife configured such that the blade is automatically retracted to a safe position within the handle when the blade is disengaged from the workpiece;

the trigger adapted to drive the blade shuttle from the rest position to the first extended position and from the rest position to the second extended position via the transmission, the blade shuttle is in a fully extended position relative to the rest position in both the first and second extended positions;

a position selector interposed between the handle and the trigger and adapted to limit a trigger stroke relative to the handle so as to drive the blade shuttle to one of the first extended position and the second extended position;

a cover, at least a portion of the cover detachably secured to the handle to provide access to the blade; and a blade cover, at least a portion of the blade cover detachably secured to the handle to provide access to the spare blade receptacle.

* * * * *

UNITED STATES PATENT AND TRADEMARK OFFICE

CERTIFICATE OF CORRECTION

PATENT NO. : 8,561,305 B2
APPLICATION NO. : 13/595406
DATED : October 22, 2013
INVENTOR(S) : Raymond E. Davis et al.

It is certified that error appears in the above-identified patent and that said Letters Patent is hereby corrected as shown below:

On the Title page, column 1, under Item 63 "Related U.S. Application Data", line 2, delete "Apr. 6, 2008," and insert -- Apr. 16, 2008, --, therefor.

Signed and Sealed this
First Day of April, 2014

Michelle K. Lee

Michelle K. Lee
*Deputy Director of the United States Patent and Trademark Office*